United States Patent [19]

Swin, Sr. et al.

[11] Patent Number: 4,711,161

[45] Date of Patent: Dec. 8, 1987

[54] DUCTLESS AIR TREATING DEVICE WITH ILLUMINATOR

[75] Inventors: Richard E. Swin, Sr., Burr Ridge; Anwar A. Atalla, Willowbrook, both of Ill.

[73] Assignee: Tec-Air, Inc., Willow Springs, Ill.

[21] Appl. No.: 318,683

[22] Filed: Nov. 5, 1981

Related U.S. Application Data

[63] Continuation of Ser. No. 57,592, Jul. 16, 1979, abandoned.

[51] Int. Cl.[4] ..... F24F 7/00

[52] U.S. Cl. ..... 98/31.5; 98/40.08

[58] Field of Search ..... 98/40 DL, 33 R; 219/361; 55/102; 362/84, 92, 95, 147, 154, 218, 221, 225, 226, 264, 289, 294, 345, 353, 375, 382, 404

[56] References Cited

U.S. PATENT DOCUMENTS

| | | | |
|---|---|---|---|
| 822,167 | 5/1906 | Vaughn | 362/92 |
| 3,846,072 | 11/1974 | Patterson | 55/102 |
| 3,909,589 | 9/1975 | Stone et al. | 98/40 DL |

*Primary Examiner*—Henry A. Bennett

*Attorney, Agent, or Firm*—August E. Roehrig, Jr.

[57] ABSTRACT

A ductless air treating device having changeable air treating and lighting elements. A vaneless diffuser fan circulates air through the unit and cools the elements thereof. The unit is mounted directly to any standard electrical junction box or alternatively, to any standard electrical socket. Adjustable aligning spacers align the ductless ventilator with the mounting surface. The fan or the light may be operated individually or together simultaneously.

13 Claims, 7 Drawing Figures

DUCTLESS AIR TREATING DEVICE WITH ILLUMINATOR

This is a continuation of application Ser. No. 057,592, filed July 16, 1979, now abandoned.

BACKGROUND OF THE INVENTION

This invention relates in general to air treating devices and, in particular, to ductless air treating devices. More specifically, but without restriction to the particular use which is shown and described, this invention relates to a ductless air treating device having replaceable air treating and lighting elements, and a vaneless diffuser fan which is the subject of the present inventor's co-pending application, Serial No. 057,592, entitled "Mixed Flow Fan with Rotating Vaneless Diffuser", filed concurrently herewith.

Recreation rooms and cooking areas generally are well illuminated and well ventilated. It is a common practice to install hoods in the vicinity of and generally directly over cooking ranges. Many such hoods are also vented either through the roof or through the wall of the building. Others incorporate a charcoal filtering element to remove grease and cooking odors for the air before returning it to the kitchen. In many instances it is also desirable to illuminate and ventilate enclosed areas such as bathrooms, closets, and passenger cars. For example, many bathrooms and powder rooms have ceiling mounted blowers or fan units, which are vented to the roof to remove steam and provide fresh air circulation.

The advent of more modern building codes has eliminated the requirement for external venting of fans, blowers and the like. Therefore, a need has arisen for a ductless air treating unit which will satisfy these codes. This invention addresses these and other problems by combining the lighting and air treating features into a simple, versatile, readily installable unit.

The ductless air treating unit disclosed herein offers several economic advantages. First, it is generally less expensive to provide a single air treating unit which performs all of the multiple illuminating and air treating functions than it is to provide separate units performing the functions individually. A second economic advantage is realized by eliminating the costs of electrical wiring for multiple separate units, nor is there any expense for venting duct installation. The device may be installed in any existing electrical junction box, or, alternatively, it may be inserted into an existing standard threaded, bayonet type or wedge type electrical socket. Thirdly, the lighting and other internal elements of the present invention are cooled by the air passing therethrough which extends the functional lifetime of these elements. This cooling feature is particularly significant in that present Underwriter Laboratory standards require that the temperature within the junction box be less than 60° C. A lighting unit containing two standard 60 watt incandescent bulbs will not pass this test. This invention brings the temperature within the air treating device within acceptable standards.

The ductless air treating device of the invention further eliminates a condition known as air stratification. Normally, the colder air is near the floor, while the hotter air is stratified near the ceiling of the room. The device, herein disclosed, if ceiling mounted, recirculates the air within the room and more evenly distributes the heat between the floor and the ceiling. The result is a reduction in the energy required to head the room in the winter and to cool it in the summer, which translates into a monetary savings to the user.

The versatile air treating features of the present invention offer several additional advantages over prior art devices. By inserting various materials in the air flow path, the unit may be modified to perform a multiplicity of functions. Air may be deodorized by drawing it through a deodorizing material, or if a filtering material is used, activated charcoal for example, the air will also be purified Alternatively, an ionizer or ozonizer may be inserted which kills germs borne in the air. Still another alternative is to insert a disinfectant media or an insecticide media, which allows the air treating device of the invention to perform still other functions.

Another problem overcome by this invention involves the theft of this type of unit from the job site during building construction. This problem is overcome by installing only the mounting plate of the invention during construction. After completion the entire unit may attach to the mounting plates or, alternatively, to a standard threaded socket.

Thus, the device of the invention provides an economical and compact unit which may selectively operate a ventilating fan or a illuminator, alone or simultaneously, with provision to additionally incorporate a deodorizing element.

SUMMARY OF THE INVENTION

It is therefore, an object of the present invention to improve air treating devices.

Another object of this invention is to improve ductless air treating devices.

A further object of the present invention is to filter and deodorize air through a ductless air treating device.

Still another object of the present invention is to incorporate changeable air treating and lighting elements in a ductless air treating device.

A further object of the present invention is to provide a low cost ductless air treating device which can be readily installed in an existing lighting fixture or standard junction box.

Yet another object of the present invention is to incorporate a changeable lighting element in a low cost and readily installable ductless air treating device.

Still another object of the present invention is to prevent the theft of air treating devices for construction job sites.

A further object of the present invention is to selectively either filter, deodorize, ionize, disinfect, exterminate insects, and circulate air or to provide illumination separately or simultaneously through a single ductless air treating device.

These and other objects are attained in accordance with the invention wherein there is provided a ductless air treating device having changeable air treating and lighting elements. A vaneless diffuser fan circulates air through the unit and also cools the elements thereof. The unit is mounted directly to any standard electrical junction box or, alternatively, to any standard electrical socket. Adjustable aligning spacers align the ductless ventilator with the mounting surface. The fan or the light may be operated individually or together simultaneously.

DESCRIPTION OF THE DRAWINGS

Further objects of the invention together with additional features contributing thereto and advantages accruing therefrom, will be apparent from the following description of one embodiment of the invention when read in conjunction with the accompanying drawings, wherein.

DESCRIPTION OF THE PREFERRED EMBODIMENT

Figure 1:
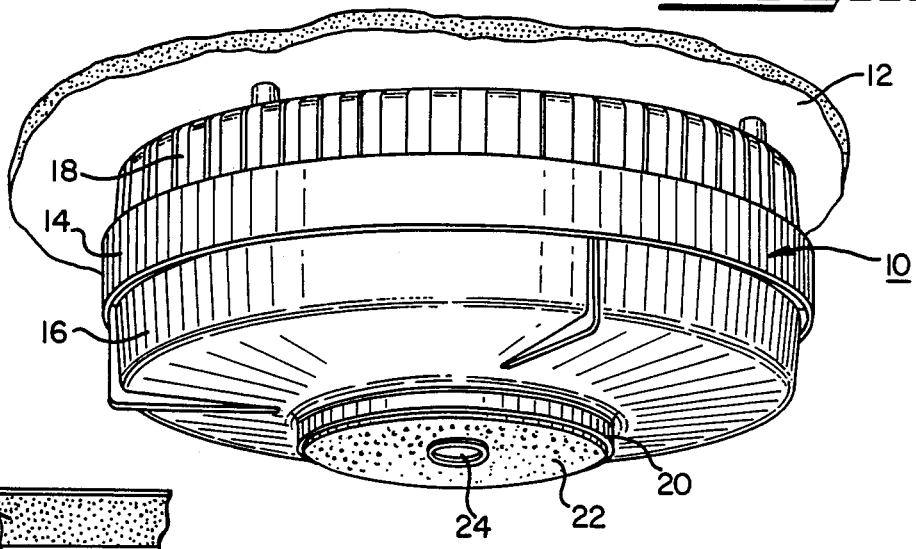
FIG. 1 is a perspective view of a ductless illuminating and air treating device mounted on a surface.

Referring now to FIG. 1 there is shown a ductless air treating device having an ornamental cover or housing shown generally by the numeral 10 mounted to a ceiling 12. Although the ductless air treating device disclosed herein may be mounted to any surface and used with housings having numerous configurations and designs, for convenience of illustration, the preferred embodiment is shown with reference to its use as a ceiling mounted ductless air treating device. Housing 10 may be constructed from any durable, light weight material, preferably plastic for ease of handling, and is separable into an upper portion 14 and a lower portion 16 to provide access to the internal components of the unit. Upper portion 14 contains discharge vents 18 which extend generally around the circumference of the device to facilitate uniform air discharge and circulation. The lower portion 16 has an air inlet 20 covered by an inlet grill 22 which is secured by a threaded fastener 24, or any other suitable quick lock device.

Figure 2:
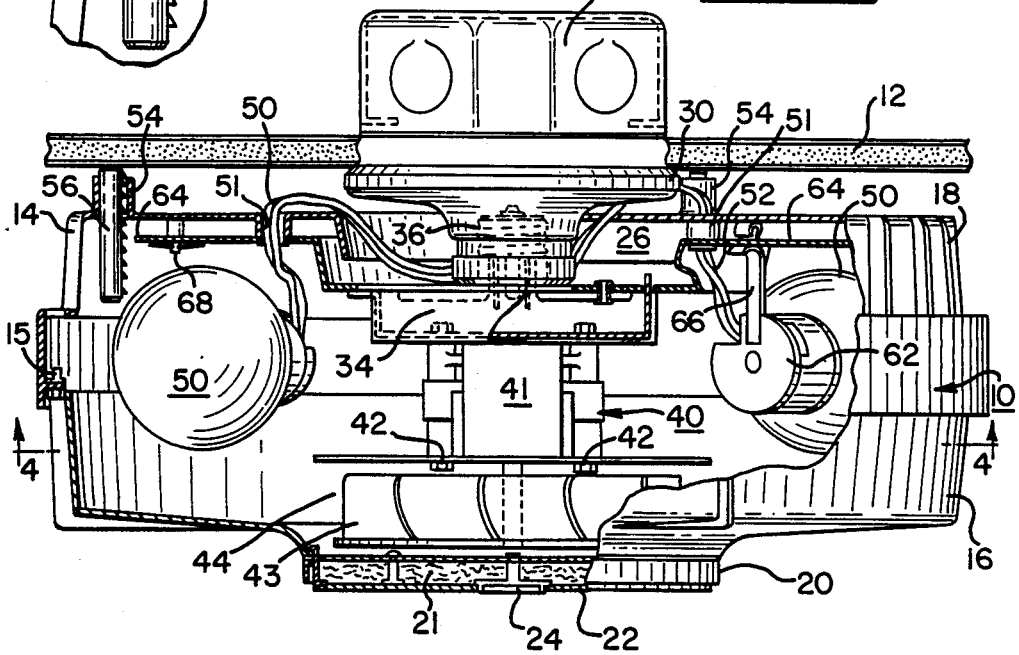
FIG. 2 is a vertical profile view of a surface mounted, ductless illuminating and air treating device mounted to a standard electrical socket having portions cut away to better illustrate the components thereof.
Figure 4:
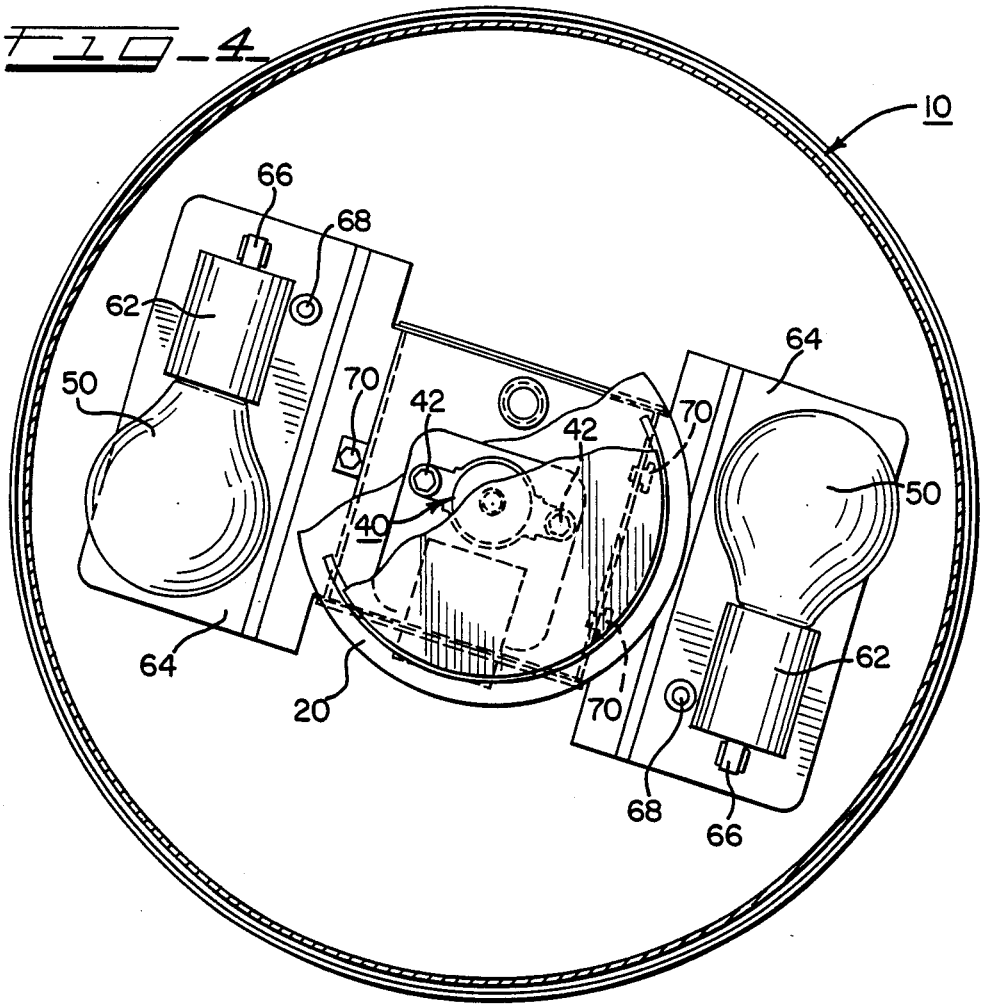
FIG. 4 is a horizontal profile view of a ductless illuminating and air treating device taken in the direction of arrows 4—4 in FIG. 2.

Referring now to FIGS. 2 and 4, the individual elements of a ductless air circulating device mounted to a standard ceramic, internally-threaded electrical socket 30 are shown in greater detail. The socket 30 is attached to a standard electrical junction box 32 mounted to the ceiling 12 in the customary manner known to those skilled in the art.

An electrical contact assembly 34 is secured to the upper portion 14 of the housing 10 and has a threaded, male electrical contact 36 adapted for insertion into the electrical socket 30. The contact assembly 34 delivers electrical energy to a motor 41, which is part of a fan assembly shown generally by the numeral 40, and to a pair of lighting elements 50 via wires 52. While in the embodiment shown the lighting elements are in the form of standard incandescent light bulbs, it is to be understood that the scope of the present invention is not limited thereto and covers other forms of illumination.

An open recess 26 is formed in the upper housing portion 14 to accommodate ceramic electrical socket 30, which, for aesthetic reasons, allows the housing to fit closely enough to the ceiling to conceal the socket 30. Holes 51, also formed in the upper housing portion permit the wires 52 access to the lighting elements 50 located within the interior of the device.

Figure 3:
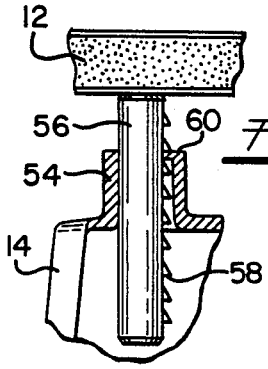
FIG. 3 is an enlarged vertical profile view of the adjustable alignment peg shown in FIG. 2.

As shown in FIG. 2 and illustrated in greater detail in FIG. 3, a pair of outwardly extending deformable cylinders 54 are formed in the top surface of the upper housing portion 14. Each cylinder is adapted to receive an adjustable spacer 56 for aligning the unit with the mounting surface 12. The spacers have a plurality of evenly spaced apart teeth or serrations 58 extending the length thereof for locking engagement with a collar 60 formed at the ends of the cylinders 54. Alignment of the air treating device is achieved by first screwing the male electrical contact 36 tightly into the socket 30. The relative alignment of the unit with respect to the mounting surface 12 is then determined by visual inspection, and the spacers 56 may then be positioned at any desired elevation by squeezing the deformable cylinders 54 to release the teeth 58 by moving the spacers inwardly or outwardly as necessary. The spacers permit alignment of the device with uneven mounting surfaces and additionally, provide support for the unit if, for example, a pull chain extending from the socket 30 across the top of the housing.is used to turn it on and off.

Referring again to FIGS. 2 and 4, the lighting elements 50 are inserted into standard light bulb sockets 62. Although not intended to be so limited, each socket may be secured to a reflector plate 64 by a clip bracket 66, and the reflector plates, in turn, are mounted to the inside of the upper housing portion 14 by appropriate means such as rivets 68 and threaded fasteners 70. The reflector plates assist in cooling the unit by reflecting the heat from the lighting elements 50 downwardly into the interior of the housing where it is quickly dissipated by the fan assembly 40 through the vents 18.

The fan assembly 40 is mounted to the electrical contact assembly 34 by any suitable fastening means, for example, in the embodiments shown, a pair of threaded bolts 42. The fan assembly includes, generally, a motor 41, an impeller 43, and a vaneless diffuser 44. For further details concerning a suitable vaneless diffuser fan assembly, reference is made to the present inventor's co-pending application entitled "Mixed Flow Fan with Rotating Vaneless Diffuser" cited previously herein.

The lower housing portion 16 is secured to the upper housing portion 14 by a plurality of screws, one of which is shown by the numeral 15 and is readily removable to provide access to the interior elements. A deodorizing or filtering element 21 is disposed in air inlet 20 formed in the bottom of the lower housing portion 16 and is held in place by the inlet grill 22 and fastener 24.

During operation of the unit, fan assembly 40 draws air into the inlet 20, where it is filtered and/or deodorized by element 21, and then dispels purified air into the room via vents 18. The moving air within the housing also serves to cool, and, therefore, prolong the life of fan motor 41 and lighting elements 50. When a filtering element becomes dirty or clogged or when a deodorizing element is exhausted, it may be easily removed for cleaning or replacement by removing the fastener 24 and the grill 22.

Figure 5:
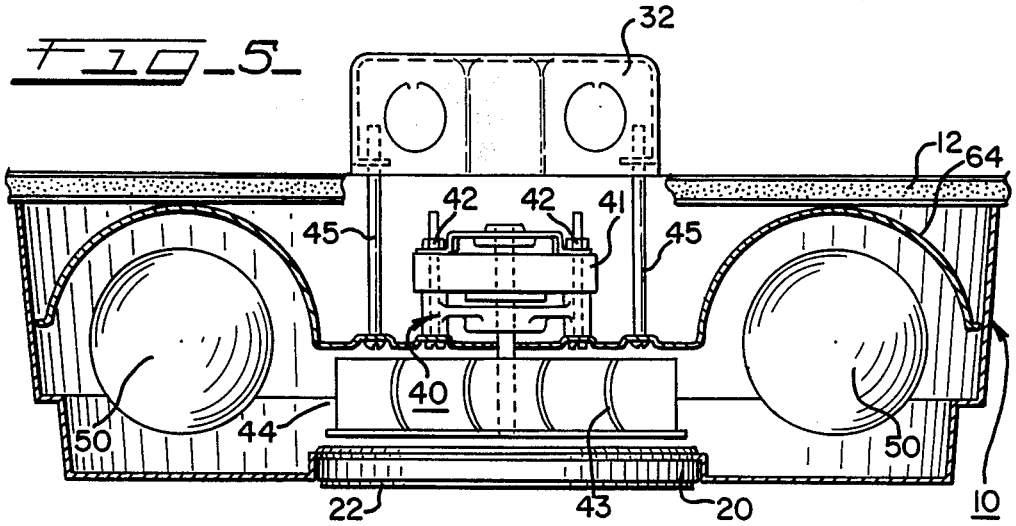
FIG. 5 is a vertical profile view of a surface mounted, ductless illuminating and air treating device mounted to a standard electrical junction box.

Referring now to FIG. 5, there is illustrated an alternate embodiment of the present invention wherein the ductless air treating device is mounted directly to the standard junction box 32. In the embodiment shown, the reflector plate 64 is secured to the interior of housing 10 and forms a single member covering the area above fan motor 41 and both lighting elements 50. Fan assembly 40 is secured to reflector plate 64 whereby a pair of screws 45 secure the entire unit to the junction box 32. Since the housing 10 fits snugly against mounting surface 12, adjustable supports 56 of the first embodiment are not needed. This embodiment provides for a relatively more stable and permanent installation, which may be desired in certain applications.

In some instances, it is desirable to operate either the light or the fan separately. For example, if the device is installed in a closet, air may be periodically circulated and purified by simply activating the fan while illumination is not needed. Conversely, in certain situations, only illumination is desired without air flow. In other instances, it may be desirable to operate both simultaneously. To this end, air treating devices may be fitted with a split electrical contact which is the subject of the present inventor's co-pending application entitled "Split Electrical Socket and Contact". For further details concerning the construction of such a split electrical contact reference is made to said co-pending application, the disclosure of which is herein incorporated by reference.

Figure 7:
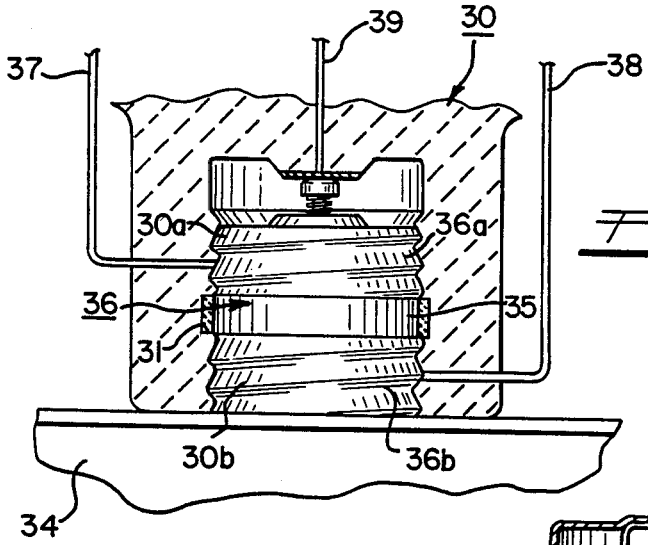
FIG. 7 is an enlarged vertical profile view of the split socket mounting shown in FIG. 6 having portions cut away to illustrate the elements thereof in greater detail.
Figure 6:
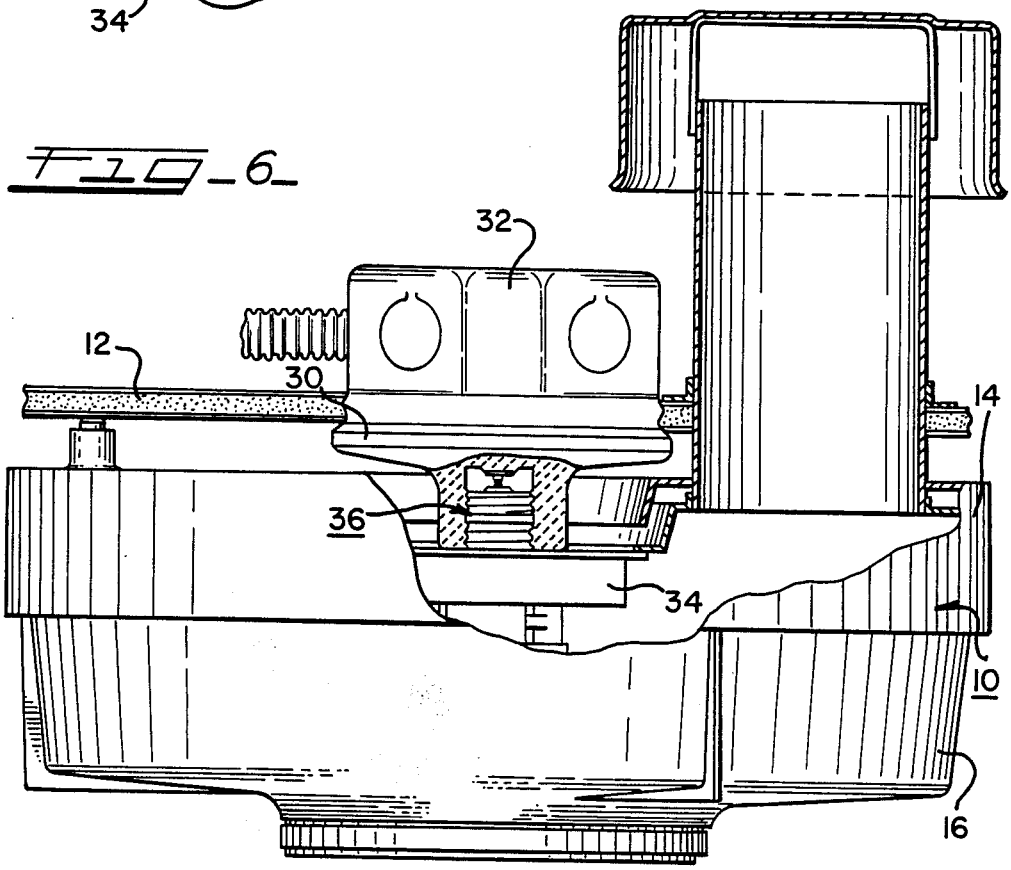
FIG. 6 is a vertical profile view of a surface mounted, ductless illuminating and air treating device which is mounted to a split electrical socket.

While reference is made to the above-mentioned application for further particulars of the operation thereof, an air treating unit equipped with a split electrical contact is shown in FIG. 6 and illustrated in greater detail in FIG. 7. Electrical contact assembly 34 is secured to the upper housing portion 14 in the manner described above. In the embodiment shown, the male electrical contact 36 is split into two segments **36*a* and 36*b* separated by an insulating portion 35. The male contact 36 is inserted into the electrical socket 30 mounted to a junction box 32 wherein the receptacle is similarly divided by an insulator 31 into two segments 30*a* and 30*b*. Contact portions 30*a* and 36*a* complete a circuit 37 for energizing one portion of the ventilator, for example, the light, and contact portions 30*b* and 36*b* complete a second circuit 38 for operating the fan portion. By connecting both circuits to a common line 39**, the elements of the air treating device may be operated separately and independently or simultaneously to achieve the desired results.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A ductless unitized air treating and illuminating module to be electrically coupled to and suspended from a ceiling electrical socket having an internally threaded electrical contact comprising a housing having an air inlet and an air outlet with a path of air flow defined therebetween, an externally threaded electrical contact fixedly secured on an outer portion of said housing and directly engagable into a ceiling mounted electrical socket having an internally threaded electrical contact for coupling a source of electrical power to within said housing, said externally threaded electrical contact fixedly secured on the outer portion of said housing to directly engage the internally threaded contact comprising an electrical contact for coupling a source of electrical power to within said housing and a support for physically connecting said housing directly to the internally threaded electrical socket when threadingly engaged therewith, air circulating means carried by said housing for drawing air thereinto through said air inlet and discharging the air drawn thereinto out through said air outlet, said air circulating means being electrically coupled to said externally threaded electrical contact fixedly secured on an outer portion of said housing, and illuminating means carried by said housing and actuable to emit light therefrom, said illuminating means being electrically coupled to said externally threaded electrical contact and positioned in thermal contact with said path of air flow to dissipate heat generated upon the actuation thereof.

2. A ductless unitized air treating and illuminating module to be electrically coupled to and suspended from a ceiling electrical socket having an internally threaded electrical contact comprising a housing having an air inlet and an air outlet with a path of air flow defined therebetween, an externally threaded electrical contact carried on an outer portion of said housing and engagable with a ceiling mounted electrical socket having an internally threaded electrical contact for coupling a source of electrical power to within said housing, said externally threaded electrical contact carried on the outer portion of said housing to engage the internally threaded electrical contact comprising a support for suspending said housing from the electrical socket when threadingly engaged therewith, said externally threaded electrical contact carried on an outer portion of said housing and engagable with a ceiling mounted electrical socket having an internally threaded contact for coupling a source of electrical power to within said housing including at least two coaxial electrically conductive contact portions electrically insulated one from the other and a third common electrical contact operatively coupled to each one of said at least two coaxial electrically insulated conductive contact portions for completing separate electrical circuits for said air circulation means and said illuminating means, air circulating means carried by said housing for drawing air thereinto through said air inlet and discharging the air drawn thereinto out through said air outlet, said air circulating means being electrically coupled to said externally threaded electrical contact carried on an outer portion of said housing, and illuminating means carried by said housing and actuable to emit light therefrom, said illuminating means being electrically coupled to said externally threaded electrical contact and positioned in thermal contact with said path of air flow to dissipate heat generated upon the actuation thereof.

3. A ductless unitized air treating and illuminating module as defined in claim 2 further including an internally threaded electrical socket assembly comrpising, at least two internally threaded electrically conductive contact portions electrically insulated one from the other, said electrically conductive contact portions which are electrically insulated one from the other being coaxially positioned and having substantially the same diameter and thread pitch for engaging said at least two externally threaded electrically conductive contact portions electrically insulated one from the other, and a third common electrical contact operatively coupled to each one of said at least two internally threaded electrically insulated conductive contact portions and electrically coupled to said third common electrical contact operatively coupled to each one of said at least two externally electrically insulated conductive contact portions.

4. The ductless unitized air treating and illuminating module as defined in claim 1 further including adjustable leveling means for selectively aligning said housing with respect to a mounting surface.

5. The ductless unitized air treating and illuminating module as defined in claim 1 further including reflector means mounted within said housing for reflecting heat from said illuminating means into said air-flow path for dissipation thereof.

6. The ductless unitized air treating and illuminating module as defined in claim 1 further including air treating means disposed in said air flow path.

7. The ductless air treating device as defined in claim 6 wherein said air treating means includes an air eodorizing element.

8. The ductless air treating device as defined in claim 6, wherein said air treating means further includes a filtering element for removing material from the air flow through the housing means.

9. The ductless air treating device as defined in claim 6 wherein said air treating means includes an ionizing element.

10. The ductless air treating device as defined in claim 6 wherein said air treating means includes a disinfectant elemnt.

11. The ductless air treating device as defined in claim 6 wherein said air treating means includes an insecticide element.

12. The ductless unitized air treating and illuminating module as defined in claim 2 wherein said illuminating means and said air circulating means are selectively operable simultaneously or independent of each other.

13. The ductless unitized air treating and illuminating module as defined in claim 1 wherein said air circulating means comprises a vaneless diffuser.

* * * * *

UNITED STATES PATENT AND TRADEMARK OFFICE

CERTIFICATE OF CORRECTION

PATENT NO. : 4,711,161

DATED : December 8, 1987

INVENTOR(S) : Richard E. Swin, Sr. and Anwar A. Atalla

It is certified that error appears in the above-identified patent and that said Letters Patent is hereby corrected as shown below:

Column 7, line 3 "comrpising" should read "comprising", line 19, after "externally" insert --threaded--.

Column 8, line 7-8, "eodorizing" should read "deodorizing".

line 18, "elemnt" should read "element".

Signed and Sealed this

Twenty-seventh Day of September, 1988

*Attest:*

DONALD J. QUIGG

*Attesting Officer*

*Commissioner of Patents and Trademarks*